US009697696B2

(12) United States Patent
Watts et al.

(10) Patent No.: US 9,697,696 B2
(45) Date of Patent: Jul. 4, 2017

(54) GAMING DEVICES AND METHODS OF OPERATING THEM

(75) Inventors: Ron Watts, Cardiff (GB); Andy Dinning, Bath (GB)

(73) Assignee: NOVOMATIC AG, Gumpoldskirchen (AT)

( * ) Notice: Subject to any disclaimer, the term of this patent is extended or adjusted under 35 U.S.C. 154(b) by 21 days.

(21) Appl. No.: 14/347,483

(22) PCT Filed: Sep. 13, 2012

(86) PCT No.: PCT/EP2012/067904

§ 371 (c)(1),
(2), (4) Date: Mar. 31, 2014

(87) PCT Pub. No.: WO2013/045276

PCT Pub. Date: Apr. 4, 2013

(65) Prior Publication Data

US 2014/0235317 A1 Aug. 21, 2014

(30) Foreign Application Priority Data

Sep. 26, 2011 (GB) ..... 1116561.0

(51) Int. Cl.
*G07F 17/32* (2006.01)

(52) U.S. Cl.
CPC ..... *G07F 17/329* (2013.01); *G07F 17/3225* (2013.01)

(58) Field of Classification Search
CPC .... G07F 17/32; G07F 17/329; G07F 17/3223; G07F 17/3225; G07F 17/323; F07F 9/02
See application file for complete search history.

(56) References Cited

U.S. PATENT DOCUMENTS 4,805,907 A * 2/1989 Hagiwara ..... G07F 17/3211 463/20
5,533,727 A 7/1996 DeMar
(Continued)

FOREIGN PATENT DOCUMENTS

EP 1993080 11/2008
GB 2352087 1/2001
(Continued)

OTHER PUBLICATIONS

International Search Report for PCT/EP2012/067904, Completed by the European Patent Office on Nov. 21, 2012, 4 Pages.
(Continued)

*Primary Examiner* — Omkar Deodhar
(74) *Attorney, Agent, or Firm* — Brooks Kushman P.C.

(57) ABSTRACT

A group of associated gaming devices each having a lottery drawer including a database having a plurality of entries each entry containing one or more winning numbers associated with a predetermined time interval, and a pseudo random number generator for generating pseudo random numbers from a seed supplied by the database, and a clock for extracting the winning number or numbers from an entry of the database for the time interval indicated by the clock, and a comparator for at least one receiving of the extracted winning number or numbers and at least one number generated by the pseudo random generator, wherein the comparator is adapted for generating a win signal when the extracted winning number and the generated pseudo random number match; and wherein all of the associated gaming devices include identical databases having the plurality of entries and pseudo random number generators whereby win signals are generated simultaneously.

10 Claims, 3 Drawing Sheets

(56) References Cited

U.S. PATENT DOCUMENTS

| | | | | |
|---|---|---|---|---|
| 5,689,587 | A * | 11/1997 | Bender et al. | 382/232 |
| 6,249,009 | B1 | 6/2001 | Kim et al. | |
| 6,419,583 | B1 | 7/2002 | Crumby et al. | |
| 6,533,664 | B1 | 3/2003 | Crumby | |
| 6,539,410 | B1 | 3/2003 | Klass | |
| 7,199,372 | B2 | 4/2007 | Kardynal et al. | |
| 7,492,901 | B2 | 2/2009 | Takemoto et al. | |
| 2002/0090986 | A1 * | 7/2002 | Cote | G07F 17/32 463/16 |
| 2004/0137987 | A1 | 7/2004 | Nguyen et al. | |
| 2004/0166923 | A1 | 8/2004 | Michaelson et al. | |
| 2004/0176167 | A1 | 9/2004 | Michaelson et al. | |
| 2004/0235551 | A1 * | 11/2004 | Walker | G07F 17/32 463/16 |
| 2006/0115086 | A1 | 6/2006 | Beausoleil et al. | |
| 2006/0234791 | A1 | 10/2006 | Nguyen et al. | |
| 2007/0127718 | A1 | 6/2007 | Ribordy et al. | |
| 2007/0260658 | A1 | 11/2007 | Fiorentino et al. | |
| 2008/0076525 | A1 | 3/2008 | Kim | |
| 2009/0093300 | A1 * | 4/2009 | Lutnick | G07F 17/32 463/26 |
| 2009/0258693 | A1 | 10/2009 | Preston et al. | |
| 2009/0292785 | A1 * | 11/2009 | Leedberg et al. | 709/206 |
| 2010/0122320 | A1 | 5/2010 | Merati et al. | |
| 2011/0223991 | A1 | 9/2011 | Powell et al. | |

FOREIGN PATENT DOCUMENTS

| | | |
|---|---|---|
| WO | 9926204 | 5/1999 |
| WO | 0016182 | 3/2000 |
| WO | 2006031693 | 3/2006 |
| WO | 2007124089 | 11/2007 |

OTHER PUBLICATIONS

Jon Von Neumann., Applied Mathematics Series 1951, vol. 12, p. 36-38, "Various techniques used in connection with random digits". Website http://en.wikipedia.org/w/index.php?title=Random_seed &oldid=434790363 Retrieved from Wikipedia on Jan. 10, 2015, XP 055217611, 2 Pages, "Random seed".

* cited by examiner

GAMING DEVICES AND METHODS OF OPERATING THEM

CROSS-REFERENCE TO RELATED APPLICATION

This application is the U.S. national phase of PCT Application No. PCT/EP2012/067904 filed on Sep. 13, 2012, which claims priority to Great Britain Patent Application No. 1116561.0 filed on Sep. 26, 2011, the disclosures of which are incorporated in their entirety by reference herein.

FIELD OF THE INVENTION

This invention relates to a group of associated gaming devices each having a lottery drawer and a method of operating gaming devices

BACKGROUND OF THE INVENTION

It is desirable in the gaming industry to, from time to time, pay an at least apparently random payout simultaneously on a group of associated machines, because this can lead to a significant event occurring in a venue and encourage machine usage. The most simple way of achieving this is using a central controller to generate an appropriate signal that is simultaneous fed to each of the machines in the group. In reality it is often difficult to hard wire all such machines to a server, particularly if the server is to be kept in a secure location. Accordingly, in many venues, at least some of the links to such gaming devices are wireless and commonly utilized a mobile telephone technology. It has been found that in many instances there are variations in signal strength over time, with the result that a particular gaming device may not receive its "random" win signal at all or may receive the signal an interval after other machines in the group. This can lead to a significant loss of visual and/or aural impact and so there is a need to overcome the problems arising from the technical unreliability of the mobile signal strength.

OBJECT AND SUMMARY OF THE INVENTION

From one preferred aspect of the invention there is a group of associated gaming devices each having a lottery drawer comprising a database having a plurality of entries, each entry containing one or more winning numbers associated with a predetermined time information, and a pseudo random number generator for generating pseudo random numbers from a seed supplied by the database, and a clock for extracting the winning number or numbers from an entry of the database for the time interval indicated by the clock, and a comparator for at least one receiving of the extracted winning number or numbers and at least one number generated by the pseudo random generator, wherein the comparator is adapted for generating a win signal when the extracted winning number and the generated pseudo random number match; and wherein all of the associated gaming devices include identical databases having the plurality of entries and pseudo random number generators whereby win signals are generated simultaneously.

An active device is one which is being played or, as indicated below, is being played and meets other criteria.

It will be understood that the system will enable the "random" win to occur simultaneously on each machine whether or not they are connected to a central controller. In general it is desirable that there is a connection to a central controller so that the clocks within the devices can be synchronized from time to time but the random win in any specific device is not dependent on whether or not the link to the controller is up at the moment of the win.

Preferably each database entry includes a header which constitutes or contains the seed for the pseudo/random generator. Conveniently the time period is twentyfour (24) hours. Preferably each data entry includes a plurality of winning numbers which are drawn off in sequence.

The number of data entries may be such that the same winning number will not be extracted on the same date for at least a two year period. Additionally or alternatively it is preferred that the number of data entries is such that the same winning number will not extracted on the same day of the week as previously occurred within the at least a two year period.

The database may have 448 entries when the machines are installed they should be set to begin with the same data entry in the sequence.

At least one device in the group may include an enabler for enabling the lottery drawer of that device when a set of predetermined conditions apply. For example the conditions may be one or more of player time, number of games played, the interval between the players and total stake.

From a further aspect the invention consists in a method of operating a group of associated gaming devices including providing each device with the same database of sequential entries containing winning numbers, each database being associated with a predetermined time interval, seeding a pseudo random number generator from the next entry in the sequence in accordance with the actual timing date, extracting a number from said next entry, comparing the extracted number and the number generated by the pseudo random number and generating a win signal if the numbers match whereby all active devices produce a win signal simultaneously.

Preferably the method includes determining if any particular device is eligible for a lottery draw. This may be done, for example, by establishing the presence of one or more of the following conditions, player time, number of games played, the intervals between plays and total stake.

Each database entry may include a header which may constitute or contain the seed for the pseudo random generator. The time interval may be 24 hours. The number of data entries may be such that the same winning number will not be extracted on the same date and/or on the same day of the week within at least a two year period. The database may have 448 entries.

From a still further aspect the invention consists in a gaming device having a lottery drawer including a memory for storing a database having a plurality of entries each containing one or more winning numbers associated with a predetermined time interval, a pseudo random number generator for generating numbers from a seed supplied by the database, a clock for extracting the winning number or numbers from an entry of the database for the time interval indicated by the clock, a comparator adapted for generating a win signal when the winning number and the generated number match. Such a device may have the features of the individual associated devices as specified above.

Although the invention has been defined above it is to be understood that it includes any inventive combination of the features set out above or in the following description.

BRIEF DESCRIPTION OF THE DRAWINGS

The invention may be formed in various ways specific embodiments will now be disclosed with reference to the accompanying drawings in which.

DESCRIPTION OF EMBODIMENTS

A gaming device generally indicated at 10 may be, for example, a slot machine having a display 11. In the proposed embodiment the gaming device 10 is intended to from time to time provide a lottery win regardless of the outcome a player achieves. This option for providing a lottery win may for example be displayed on the display 11. The display 11 may be on each device or may be shared with a group of devices. As has been explained above the technical utility of the lottery arrangements of the invention is specifically advantageous in the context of a group of devices.

Devices may be "active" (that is eligible for the lottery) simply by virtue of being played or predetermined criteria may need to be satisfied. For example, the player may need to play one or more consecutive games with only a few seconds delay between the end of one game and the start of the other or they may have to have put in a certain level of stake before they become eligible.

Figure 1:
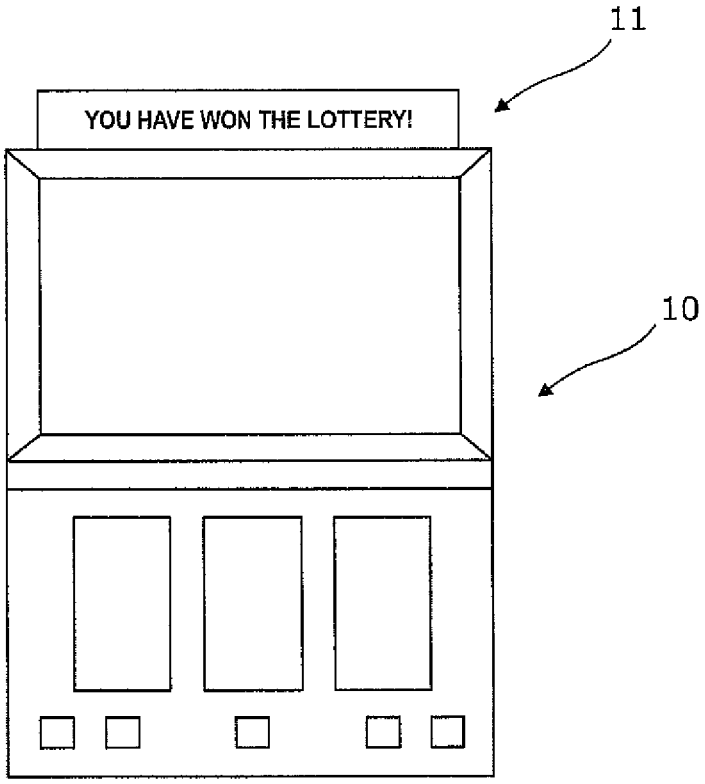
FIG. 1 is a diagrammatic view illustrating an example of the external appearance for gaming device.
Figure 2:
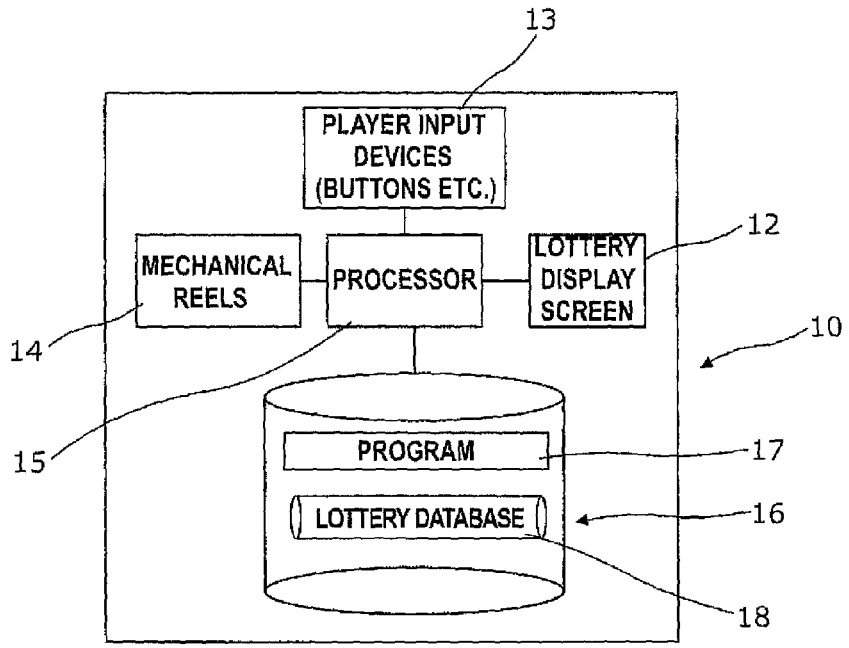
FIG. 2 is a block diagram illustrating the components of the gaming device of FIG. 1.
Figure 3:
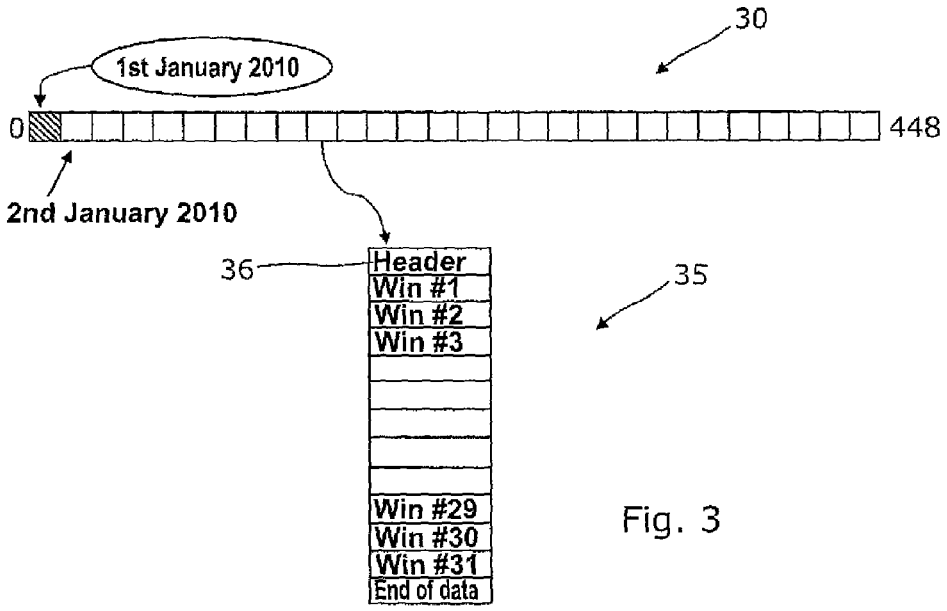
FIG. 3 is a table illustrating an example lottery database for use in embodiments of the invention.

As can be seen in FIG. 2 the gaming device 10 may include player inputs 13 such as mechanical buttons and/or touch screen buttons, mechanical and/or video reels 14, a processer 15, a memory 16 and a lottery display 12. The memory 16 may contain a program 17 to operate a computer, and a database 18. The database 18 will contain winning lottery numbers. The database 18 may be constructed or organized as indicated in FIG. 3 as a series of sequential entries 30 which may be accessed for example one after the other. In one proposed embodiment, as shown in FIG. 3, each data entry 35 will equate to a twentyfour (24) hour interval and will contain one or more winning numbers and a header 36. A start date will be associated with the first entry. In FIG. 3 this start date is 1 Jan. 2010.

The header 36 for each data entry 35 may also contain information on the number of lotteries to be drawn during the twentyfour (24) hour interval. This will enable the return from the lottery to be increased or decreased as necessary for the venue at which the gaming is located.

In the present embodiment lotteries are drawn periodically during the twentyfour (24) hour interval. Assuming that a particular gaming device 10 is active, the respective player will win a lottery, when it is announced or at the end of the game which has been played at the time.

When the end of the entries 30 of the database 18 is reached, then the series of sequential entries 30 will wrap round to the beginning and its length is selected so as to avoid the same number being drawn either on the same day or the same date for the likely life of the gaming device 10 at a venue. In FIG. 3 there are 448 data entries in the present example.

Figure 4:
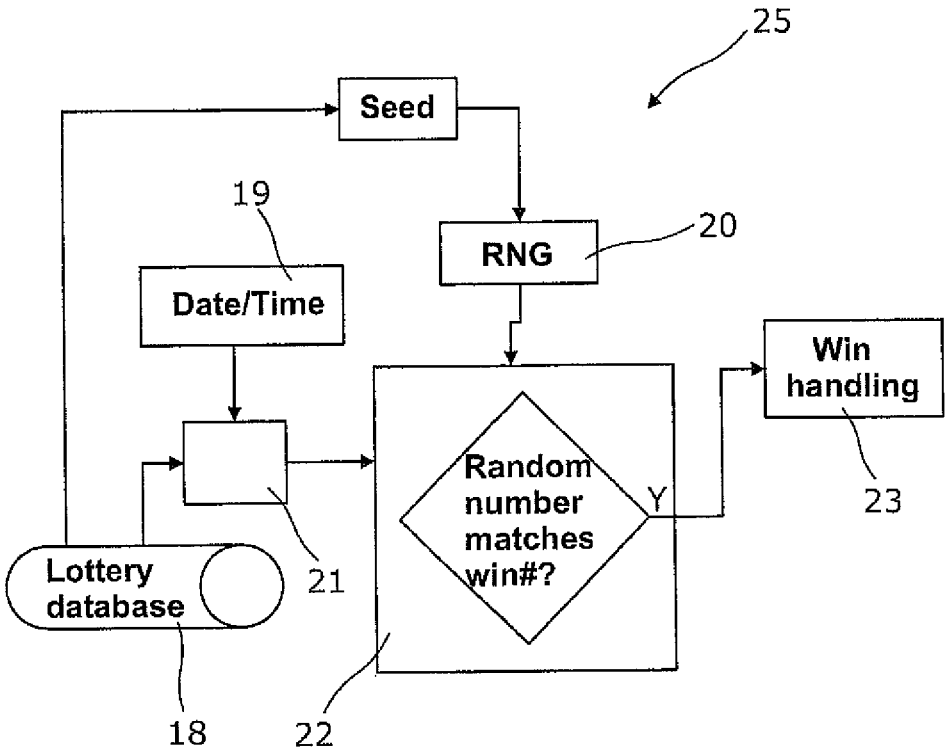
FIG. 4 is a flow chart illustrating the operation of the lottery associated with the gaming device of FIG. 1.

The operation can be well understood from FIG. 4 where a lottery drawer 25 according to an embodiment of the invention is shown. At the beginning of the twentyfour (24) hour interval as identified by the clock 19 the header 36 is fed to seed a pseudo random number generator 20. This pseudo random number generator 20 then generates random numbers. The clock 19 further draws winning numbers out of the relevant data entry 35 through a gate 21 and feeds it to a comparator 22 in the processer 15. If the number extracted from the data entry 35 of the database 18 matches the pseudo random number supplied by the random generator 20 then a win signal is generated at 23. The win is signaled to the player and the payout made as described above.

All gaming devices 10 within the group of gaming devices are provided with the same operating structure, database and pseudo random number generator. Accordingly the gaming devices 10 in the group will generate win signals at 23 simultaneously, whether or not their link to a central controller is up. As any disruption in the link is temporary, the clocks will remain sufficiently synchronised for apparent simultaneity to be maintained and so the disadvantages with wireless links set out above is overcome. In a further embodiment synchronization means may be provided to enable synchronization of the clock 19 of the respective gaming devices, for instance by means of reference-broadcast synchronization.

According to a further embodiment the database 18 and/or entries of the database 18 may be encrypted, for instance by DES, 3DES, AES or better, for security reason. A decryption block may be provided for decryption of database entries prior to further processing. Furthermore, means may be provided to protect the integrity and authenticity of the entries during processing, for example, verification of a message authentication code (MAC) or a digital signature.

It will be readily apparent to one of ordinary skill in the art that the various processes described herein may be implemented by, e.g., appropriately programmed general purpose computers, special purpose computers and computing devices. Typically a processor e.g., one or more microprocessors, one or more microcontrollers, one or more digital signal processors will receive instructions e.g., from a memory or like device, and execute those instructions, thereby performing one or more processes defined by those instructions. A "processor" means one or more microprocessors, central processing units CPUs, computing devices, microcontrollers, digital signal processors, or like devices or any combination thereof.

While the present invention is disclosed in terms of various specific embodiments, it can be appreciated that these embodiments are by way of example only. There are several variations contemplated by the present invention, and with the popularity of electronic gaming interfaces, the term "reel" should be broadly understood to include display means for displaying any set of images, defining a matrix, that are used to establish a payout.

The invention claimed is:

1. A group of associated gaming devices each having a lottery drawer, each gaming device comprising:

a database having a plurality of data entries, each data entry containing a header and one or more winning numbers associated with a predetermined time interval;

a pseudo random number generator for generating pseudo random numbers from a seed supplied by the database, wherein the header of the respective data entry of the database constitutes or contains the seed for the pseudo random number generator; and a clock for extracting the winning number or numbers from a data entry of the database and to feed the header of the data entry to seed the pseudo random number generator for that time interval indicated by the clock; and a comparator for at least one receiving of the extracted winning number or numbers and at least one pseudo random number generated by the pseudo random generator, wherein the comparator is adapted for generating a win signal when the extracted winning number and the generated pseudo random number match;

wherein all of the associated gaming devices include identical databases having the plurality of entries, each entry containing a header and one or more winning numbers associated with a predetermined time interval, and pseudo random number generators whereby win signals are generated simultaneously.

2. The device of claim 1 wherein each database entry includes a header, which contributes or contains the seed for the pseudo-random generator.

3. The device of claim 1 wherein the time interval is twenty-four hours.

4. The device of claim 1 wherein the number of data entries is such that the same winning number will not be extracted on the same date for at least a two year period.

5. The device of claim 4 wherein the number of data entries is such that the same winning number will not be extracted on the same day of the week as previously occurred within at least a two year period.

6. The device of claim 1 wherein the database has 448 entries.

7. The device of claim 1 wherein the conditions are one or more of: player time, number of games played, the interval between plays and total stake.

8. A method of operating a group of associated gaming devices comprising:

providing each gaming device in a group of associated gaming devices with the same database comprising a plurality of identical sequential entries, each data entry containing an identical header and one or more winning numbers being associated with a predetermined time interval, operating a pseudo-random number generator to generate numbers from a seed supplied by the database, extracting a number from said data entry in accordance with the actual time and date from a clock, comparing the extracted number and the number generated by the pseudo random number generator and generating a win signal if the numbers match whereby all active gaming devices produce a win signal substantially simultaneously.

9. The method of claim 8 further comprising determining if any particular gaming device has satisfied one or more of the following conditions, player time, number of games played, the intervals between plays and total stake to become eligible for a lottery draw.

10. A group of associated gaming devices each having a lottery drawer for enabling a random win to occur simultaneously on each associated gaming device whether or not they are connected to a central controller, the lottery drawer of each gaming device comprising:

a database having a plurality of data entries, each data entry containing one or more winning numbers associated with a predetermined time interval, wherein all of the associated gaming devices include identical databases having the plurality of data entries set to begin with the same entry;

a pseudo random number generator for generating pseudo random numbers from a seed supplied by the respective data entry of the respective database, wherein all of the associated gaming devices include identical pseudo random number generators; a clock for extracting the winning number or numbers from a data entry of the database for that time interval indicated by the clock; and a comparator for at least one receiving of the extracted winning number or numbers and at least one pseudo random number generated by the pseudo random generator, wherein the comparator is adapted for generating a win signal when the extracted winning number and the generated pseudo random number match, wherein the win signals being generated simultaneously in each of the groups associated gaming devices.

* * * * *